United States Patent [19]

Kirby et al.

[11] Patent Number: 4,788,897

[45] Date of Patent: Dec. 6, 1988

[54] MULTIBEAT DRUM PEDAL

[76] Inventors: Eric J. Kirby, 132 Jefferson St., NW.; Lawrence C. Smith, 119 Ingraham St., both of Washington, D.C. 20011

[21] Appl. No.: 114,517

[22] Filed: Oct. 30, 1987

Related U.S. Application Data

[63] Continuation-in-part of Ser. No. 29,983, Mar. 25, 1987, abandoned.

[51] Int. Cl.[4] ..... G10D 13/02
[52] U.S. Cl. ..... 84/422 R
[58] Field of Search ..... 84/422

[56] References Cited

U.S. PATENT DOCUMENTS

| | | | |
|---|---|---|---|
| 3,618,441 | 11/1971 | Fearns | 84/422 R |
| 4,188,853 | 2/1980 | Bills | 84/422 R |
| 4,567,808 | 2/1986 | Smith | 84/422 R |
| 4,691,613 | 9/1987 | Jacobson | 84/422 R |

*Primary Examiner*—Lawrence R. Franklin
*Attorney, Agent, or Firm*—Joseph J. Zito

[57] ABSTRACT

A mechanism for producing a multiple number of drum beats from a single downward depression of a drum foot pedal. A slipping linkage is utilized to produce multiple oscillations of a shaft member during the continuous downward motion of the drum pedal. The drum mallet is attached to the oscillatory shaft and therefore produces a number of beats for each foot pedal depression.

9 Claims, 7 Drawing Sheets

20
22
24
26
28
30
32
34
36
38
40
42
44
46
50
52
54
56
58
60
66
68
70
72
74
76
78
80
82
86
90
C

MULTIBEAT DRUM PEDAL

This is a continuation-in-part of Ser. No. 07/29,983, filed Mar. 25, 1987, now abandoned.

BACKGROUND OF THE INVENTION

A number of foot-actuated drum beaters are available in the prior art. These drum beaters include single-hammer, single-pedal beaters as taught by Fearns U.S. Pat. No. 3,618,441, and multiple-hammer beaters as taught in Escamilla U.S. Pat. No. 3,988,957 and Bills U.S. Pat. No. 4,188,853, and multiple-pedal multiple-hammer drum beaters as taught in Carver 3,968,718. Each of these beater arrangements is configured to provide a multiple number of beats to a drum.

Fearns relies upon a foot pedal which must be rocked forward with the toe and backward with the heel to provide the multiple drum beats. Escamilla relies on a similar action. However, two hammers and a split foot pedal are utilized to accomplished the multi beat. Carver relies upon multiple hammers and two drums to create a multi-beat sound. Bills teaches a beater which selectively utilizes one or two hammers to produce a dual-beat sound. In order to create two beats for each hammer, an oscillating shaft, which causes the hammer to strike the drum once during the downward movement of the pedal and once during the upward movement of the pedal, is utilized.

Of the drum beaters taught in the prior art, those producing more than one beat per hammer utilize the downward motion of a foot pedal to create the first beat, and the upward motion to create a second beat. These devices are therefore limited to producing two beats per pedal action and do not allow the drum player to select a single beat, because upon release of the pedal, the second beat is automatic.

SUMMARY OF THE INVENTION

It is an object of the present invention to provide a selectable multi-beat drum-actuating mechanism utilizing a single hammer and single foot pedal.

It is another object of the present invention to provide a multi-beat foot pedal, wherein the number of beats produced is selectable by the drum player at the time of foot pedal depression.

It is a further object of the present invention to provide a multi-piece foot pedal wherein the drum player can select the number of multi beats without altering the actuation mechanism through selective positioning of levers or otherwise.

It is yet another object of the present invention to provide a multi-beat drum pedal mechanism wherein the number of beats is selectable through alternate configuration of the mechanism.

It is still another object of the present invention to provide a multi-beat drum pedal mechanism wherein the hammer is caused to strike the drum a selectable multiple number of times during the positive downward depression of the foot pedal.

It is yet a further object of the present invention to provide a multi-beat drum pedal mechanism wherein the hammer is caused to strike the drum surface a multiple number of times during the positive downward stroke of the foot pedal, and wherein the hammer remains at rest during the upward return stroke of the foot pedal.

These and other objects of the present invention are accomplished through the unique mechanism as disclosed herein, wherein a single foot pedal is utilized to actuate a single drum hammer for striking a drum surface. During the downward stroke of the foot pedal, the hammer is driven into striking engagement with the drum surface, and then allowed to recoil to rest position. While continuing in the down stroke, the pedal-actuated mechanism re-engages the drum hammer and again causes it to impact the drum surface and then recoil to rest position. This engagement/recoil sequence is repeated a selectable number of times during the downward stroke of the pedal, to accomplish a multi-beat drum sound. The drum player has the option of stopping the downward movement of the pedal at any time to actively select the number of drumbeats in a given succession.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF PREFERRED EXEMPLARY EMBODIMENTS

Figure 1:
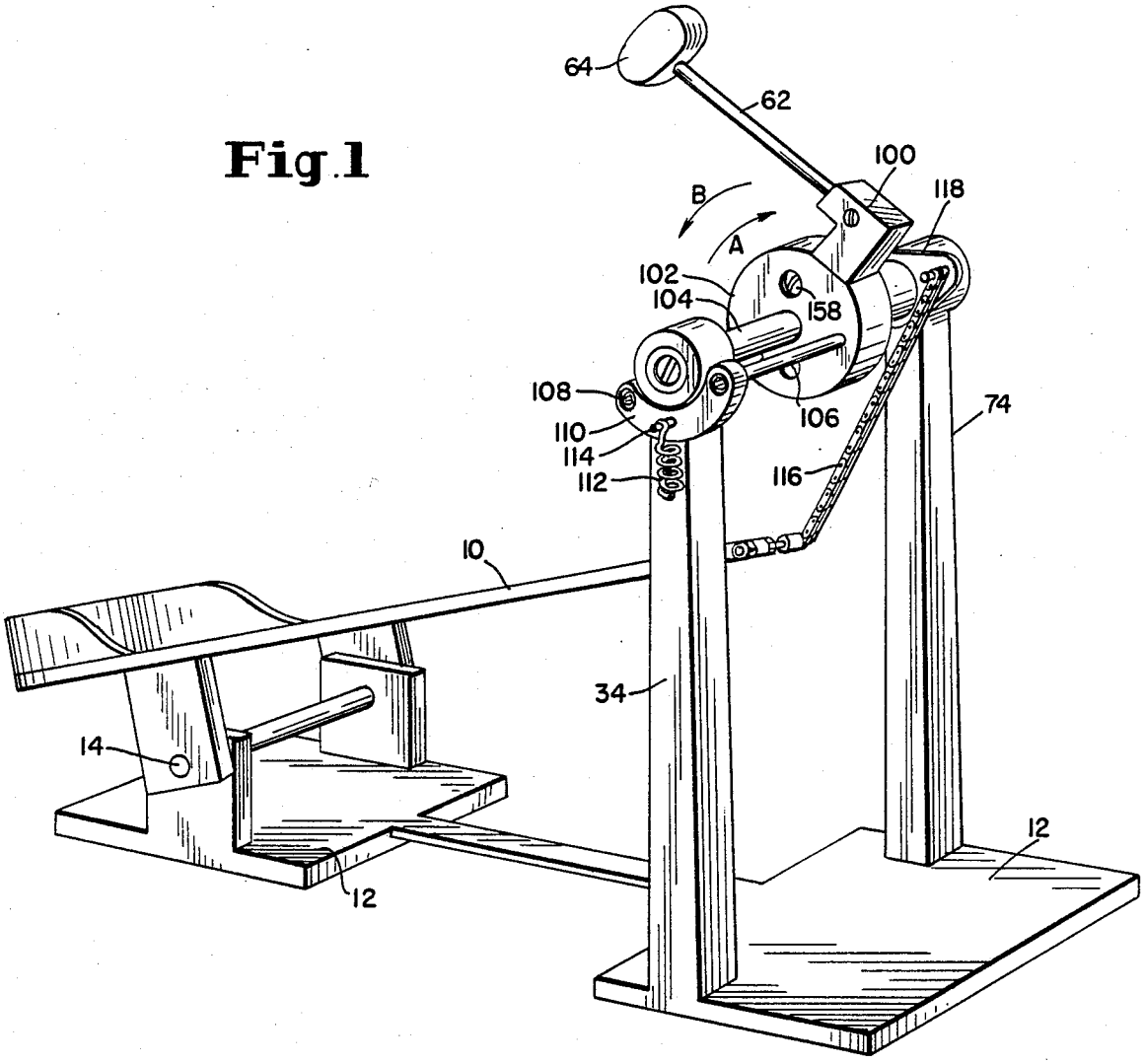
FIG. 1 is a perspective view of a first embodiment of a multi-beat drum pedal and hammer mechanism built in accordance with the teachings of the present invention.
Figure 5:
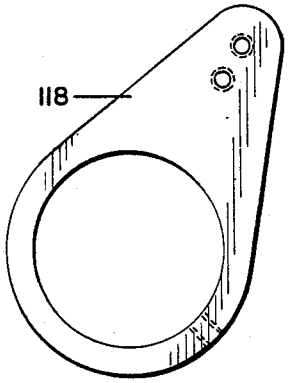
FIG. 5 is a side view of the drive arm of a first embodiment of the present invention.
Figure 6:
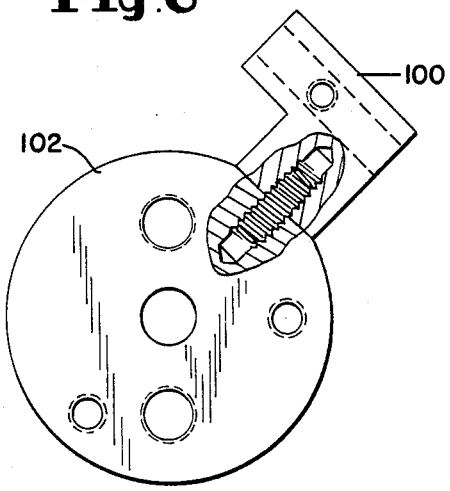
FIG. 6 is a side view of the mallet mount and mallet drive arm of a first embodiment of the present invention.
Figure 2:
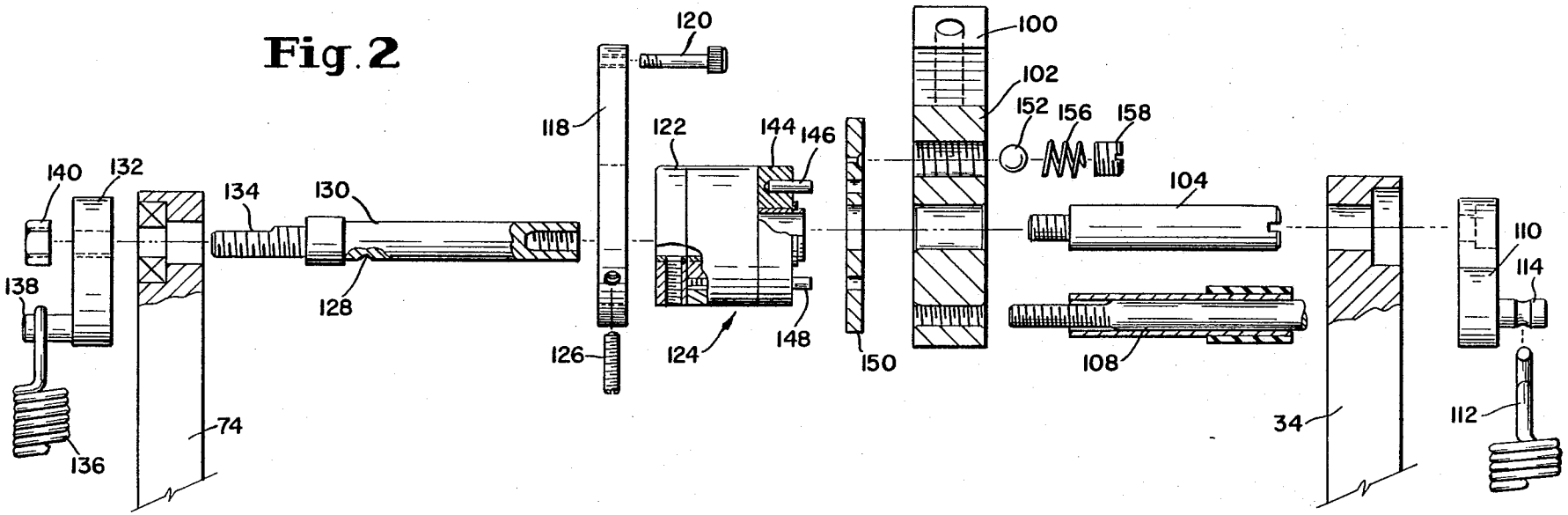
FIG. 2 is a front assembly view of the major drive components of the hammer-actuating mechanism of a first embodiment of the present invention built in accordance with the teachings herein.

A first preferred embodiment of the present invention, illustrated in FIGS. 1–7, and a second preferred embodiment of the present invention, illustrated in FIGS. 8–13, each provide for a multibeat drum sequence utilizing the concept as taught by the present invention embodied in two distinct mechanisms. In FIG. 1 there is illustrated foot pedal 10 attached to base plate 12 along pivot 14. Base member 12 also further supports upright members 34 and 74. The drumbeat-producing mechanism is mounted at the top of support members 34 and 74, and is comprised of a number of components better illustrated through reference to FIG. 2, as well as FIG. 1. Mallet 64, utilized for striking the drum, and mallet stem 62 are attached to mallet-mounting member 100, which is attached to driven member 102. Driven member 102 is mounted on the first shaft half 104 and rotates freely on shaft 104. Forward stop member 106, illustrated in FIG. 1 and recoil stop member 108, illustrated in FIG. 2, attach driven member 102 to crescent-shaped reset member 110. Spring 112, attached to Vertical support 34 and to pin 114 of reset member 110, is utilized to urge reset member 110 to the rest position, illustrated in FIG. 1

Actuation of foot pedal 10 causes the mallet and associated mechanisms to rotate in the direction indicated by arrow A in FIG. 1 Operation of reset spring 112 and reset member 110 causes the mallet mechanism to recoil in the direction indicated by arrow B of FIG. 1, in order to return to the rest position. Continued downward actuation of foot pedal 10 will cause the mallet to move forward again in the direction indicated by arrow A, and again recoil after striking the drum. In this manner, reset spring 112 and reset member 110 will continue to cause the recoil of mallet 64 after striking the drum, as pedal 10 is further depressed to cause further drum beats.

Depression of foot pedal 10 causes drive linkage 116, which is connected to drive arm 118 by pin 120, to rotate drive arm 118 in the direction indicated by arrow A. Drive lever 118 fits around first end 122 of clutch member 124, and is secured by screw 126. Screw 126 extends through clutch member 124 and engages notch 128 in second shaft 130. Clutch 124, as illustrated herein, is of the wrap spring type, but can be comprised of any type clutch which provides for rotation of both halves in unison in one direction and allows independent rotation of the halves in the other direction.

When drive arm 118 is rotated, the first end 122 of clutch member 124 is simultaneously rotated, as is second shaft 130. Rotation of second shaft 130 causes rotation of pedal reset member 132, which is attached to the flat portion 134 of the end of shaft 130. Return spring 136 is attached to pin 138 of pedal return member 132 to urge return member 132 to the rest or neutral position, in order to provide a recoil to return pedal 10 to the up position. Nut 140 is utilized to hold member 132 onto shaft 130.

Figure 3:
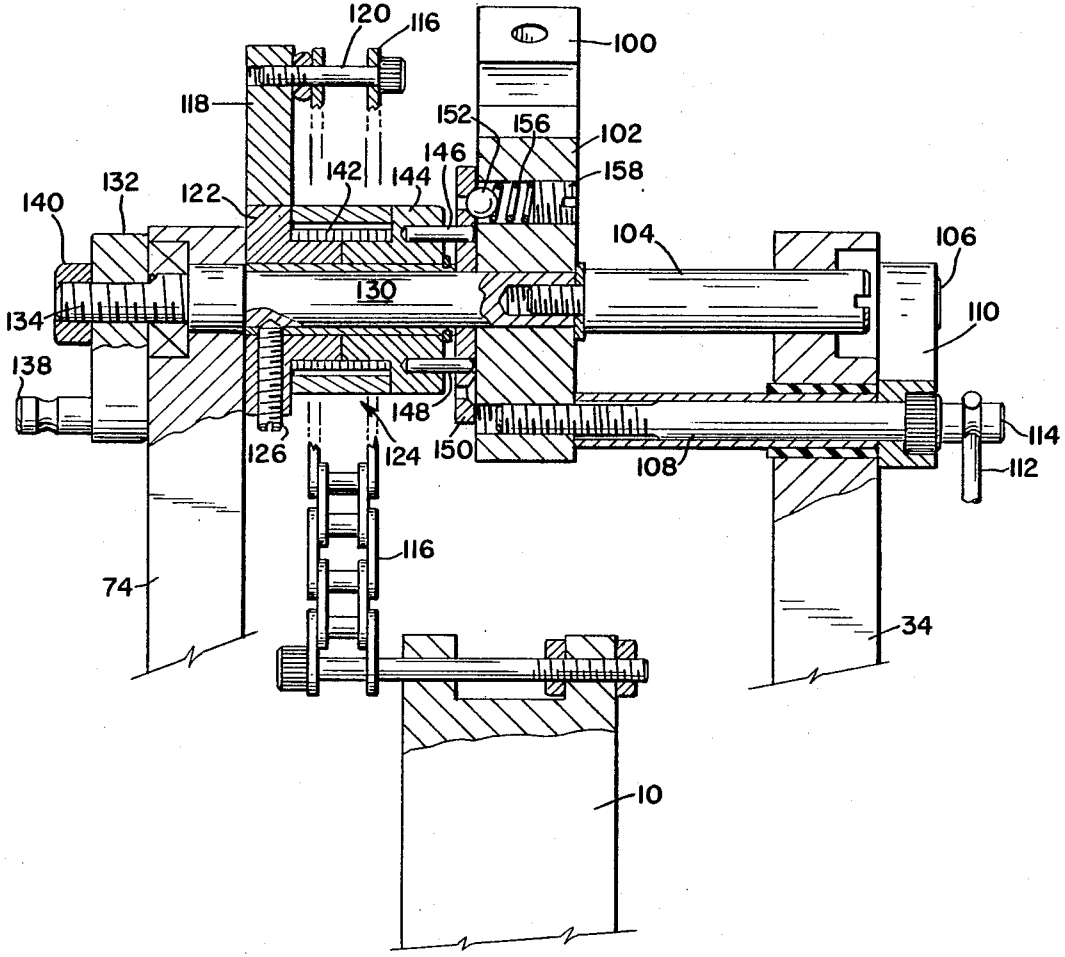
FIG. 3 is a cross-sectional view of the drive mechanism of a first embodiment of the present invention taken along line 33 of FIG. 4.

When first end portion 122 of clutch member 124 is rotated in the direction indicated by arrow A, wrap spring 142, better illustrated in FIG. 3, is wound tightly about the middle portion of both first end portion 122 and second end portion 144, thereby causing both halves of clutch 124 to rotate together. Pins 146 and 148, extending from clutch 124 into drive member 150, cause drive member 150 to also rotate in unison with clutch 124.

As drive member 150, which is better illustrated in FIGS. 7A–E, is rotated, it will cause the simultaneous rotation of driven member 102, due to the engagement of balls 152 of driven member 102, in holes 154 of drive member 150. Balls 152 maintain their engagement in holes 154, due to the pressure exerted from spring 156 associated with each ball Cap member 158 is utilized to maintain the spring and ball seated in the openings in driven member 102.

As drive member 150 rotates, driven member 102 will be rotated simultaneously, as long as balls 152 remain engaged in holes 154. At some point, the force exerted by return spring 112 will be enough to overcome the engagement of balls 152 in sockets 154. At this point, driven member 102 will slip backwards in the direction indicated by arrow B from drive member 150. Balls 152 Will re-engage holes 154 once driven member 102 has slipped back sufficiently to relieve enough of the bias of spring 112.

As pedal 10 continues to be depressed, drive member 150 Will continue to rotate in direction A. Once balls 152 re-engage, member 102 will again be rotated in direction A, until the force is again overcome by the extension of return spring 112. Each time member 102 is rotated in direction A, mallet 64 will strike the drum to produce a beat, and will then return toward rest position.

The engagement force of balls 152 in sockets 154 can be overcome either by the mallet's striking the drum, the extension of spring 112, or a combination thereof. In any event, once the engagement is overcome, the mallet will quickly return toward rest position, due to the force exerted by return spring 112.

Once the downward force exerted by the drum player on pedal 10 is removed, return spring 136 will urge pedal 10 upward to the rest position, through reverse rotation of return member 132 in the direction indicated by arrow B. As the pedal is returned to the rest position, drive arm 118, as well as the first half 122 of clutch member 124, are counter-rotated in the B direction. During rotation of the first half of clutch member 124 in the B direction, wrapped spring 142 is not tensioned, and therefore, the first half 122 will rotate independently of the second half 144 of clutch 124. This, thereby, allows for the return of pedal 10 to the rest position without the counter-rotation of mallet and associated drive member 102.

Forward stop bar 106, connected between return member 110 and member 102, is utilized to prevent the mallet and mallet drive mechanism from rotating too far in a forward direction, when being driven by the pedal, to produce a drum beat. Member 106 Can be utilized to assist in overcoming the engagement of balls 152 in sockets 154 by its contact with support member 134. Or member 106 can be utilized simply as a safety, if the force of mallet 64 striking the drum, combined with the tension of spring 112, is insufficient to overcome the engagement of balls 152 in sockets 150.

Recoil stop bar 108, also connected between return member 110 and member 102, is utilized to prevent the mallet and mallet drive mechanism from rotating too far in the return direction, when pressure is released from the foot pedal, returning all members to the rest position.

Figure 7C:
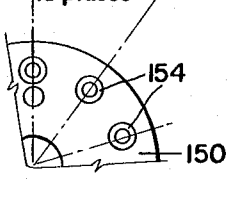
FIGS. 7A–E are detailed views of the drive plate of a first embodiment of the present invention.
Figure 7B:
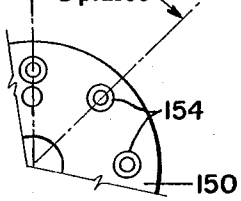
Figure 7A:
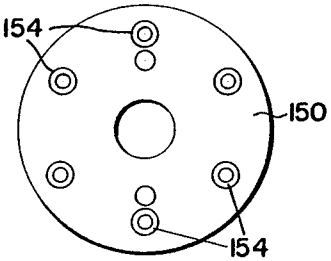
Figure 7D:
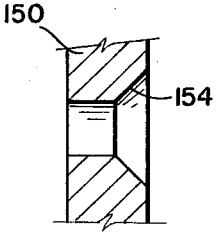
Figure 7E:
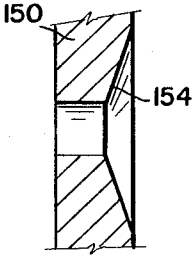
Figure 4:
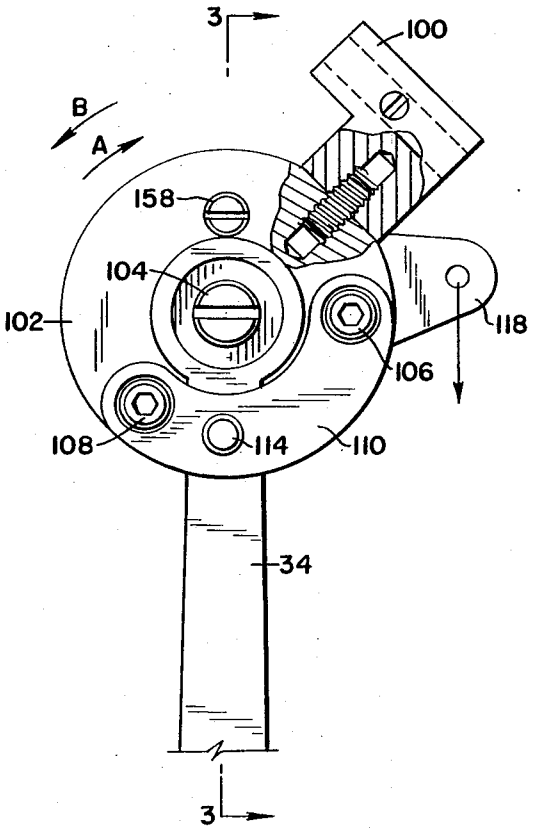
FIG. 4 is an end view of the drive mechanism of the present invention illustrating the forward rotational end recoil directions of the present invention.

As illustrated in detail in FIGS. 7C–7E, sockets 154 of drive member 150 can assume a variety of configurations. For example, there can be six sockets evenly spaced about the surface of drive member 150, as illustrated in FIG. 7A. In this instance, the sockets would be spaced about every sixty degrees. An alternative could have eight sockets, as illustrated in FIG. 7B, spaced about every forty-five degrees. There could also be ten sockets, as illustrated in FIG. 7C, spaced approximately every thirty-six degrees. Any number of sockets, spaced about the face of drive member 150, can be utilized. The number of spring-biased balls incorporated into member 102 should either correspond to the number of holes in drive member 150, or should be some even multiple of the number of holes. For example, if six sockets 154 are utilized, six balls and associated spring mechanisms can be utilized. Or, perhaps, twelve balls and associated spring mechanisms. The ratio of balls to sockets is a matter of design choice, based upon the needs for engagement forces and pressures, given the particular application of the drum beat pedal mechanism.

Also, the sloping sides of the socket can take on a number of various configurations. The sides of the socket can be steeply sloped, as illustrated in FIG. 7B, or can be more gently sloped, as illustrated in FIG. 7E. A more gentle slope will provide a smoother operation of the device, but will not provide as great an engagement force as more steeply-sloped sides. Again, this is a design consideration, based upon the specific needs and application for a device built under the teachings of the present invention.

Figure 8:
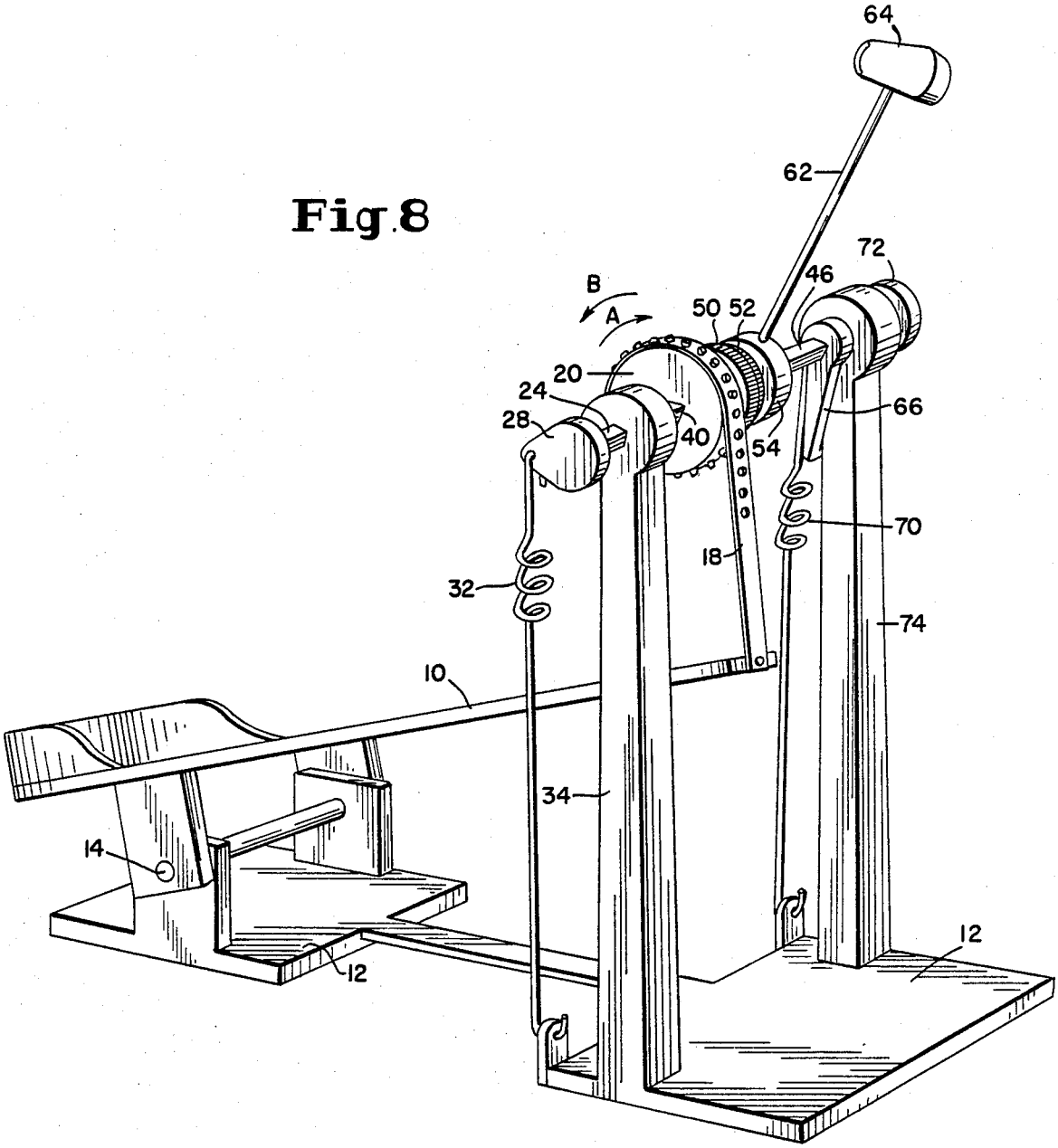
FIG. 8 is a prospective view of a second embodiment of a multi-beat drum pedal and hammer mechanism arranged in accordance with the teachings of the present invention.

In a second preferred embodiment of the present invention, as illustrated in FIG. 8, a foot pedal 10 is pivotally connected to its base 12 by pivotal axis 14. Drum pedal 10 is depressed by the drum player to cause mallet 64 to strike the drum surface. Pedal 10 will return to the toe-up position illustrated in FIG. 8 upon release by the drum player.

Figures 10, 11A, 11B, 11C:
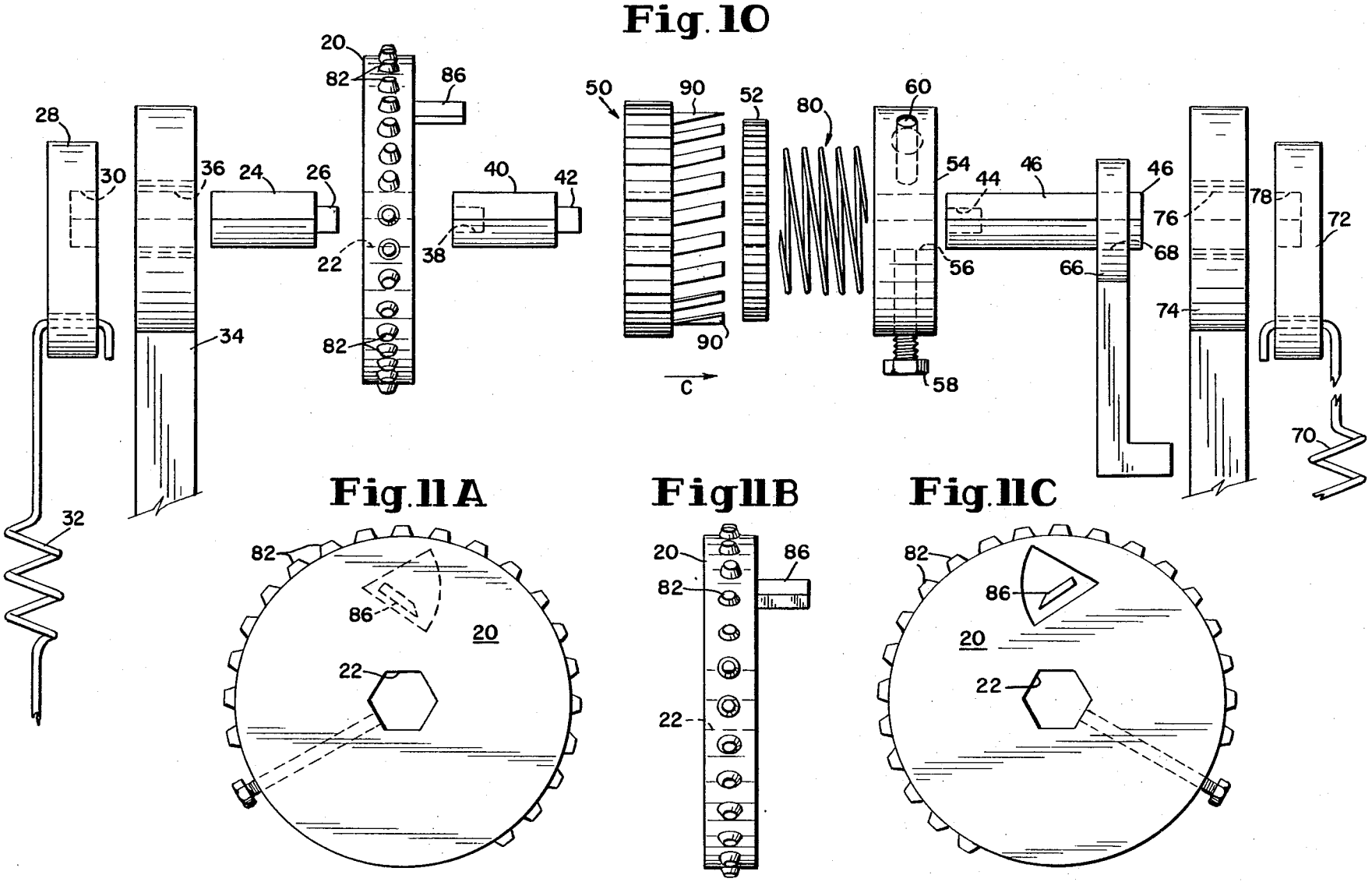
FIG. 10 is a back assembly view of a second embodiment of the major components of the hammer-actuating mechanism in accordance with the teachings of the present invention.
FIGS. 11A–C are detailed views of a second embodiment of the pedal gear of the present invention.

When moved to the toe-down position, pedal 10 through drive belt 18 will rotate pedal gear 20 in a clockwise manner when viewed as in FIG. 8. A more detailed view of pedal gear 20 is illustrated in FIGS. 11A, B and C. Gear 20 has a central octagonal hole 22 which fits around pedal gear shaft 24, thereby causing shaft 24 and gear 20 to rotate in unison. Shaft 24 is of hexagonal cross-sectional shape and fits within hole 22 in gear 20 and into hexagonal hole 30 in end piece 28.

Spring 32 is attached to end piece 28 in order to provide a torsional bias to shaft 24 to return gear 20 to its most counterclockwise position, thereby causing belt 18 to exert a force on pedal 10 to return pedal 10 to the toe up position. Shaft 24 also passes through upright 34. A bearing 36 is provided in the upper end of upright 34 to allow shaft 24 to freely rotate within upright 34.

The narrow end 26 of shaft 24 is cylindrical and fits into the opening 38 in mallet driver shaft 40. Shaft 40 is provided with a bearing surrounding opening 38 to provide for free independent rotation of shafts 24 and 40. The narrow end 42 of shaft 40 fits into hexagonal opening 44 in mallet shaft 46. Mallet shaft 46 and driver shaft 40, therefore, rotate in unison.

Figure 12A:
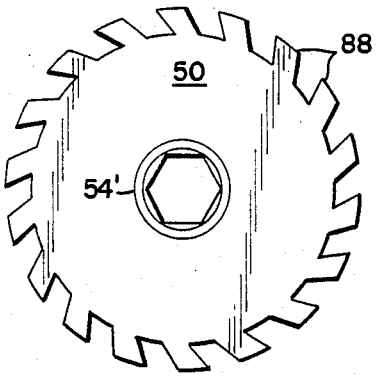
FIGS. 12A–C are detailed views of a second embodiment of one portion of the mallet driver of the present invention.
Figure 12B:
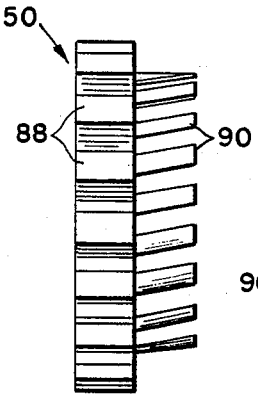
Figure 12C:
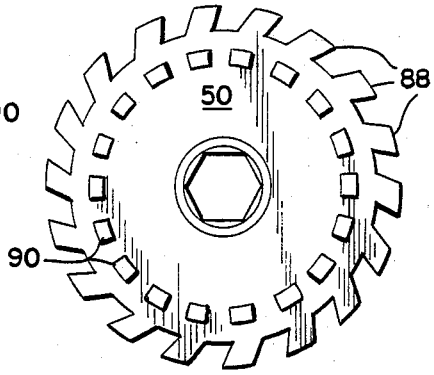
Figure 13A:
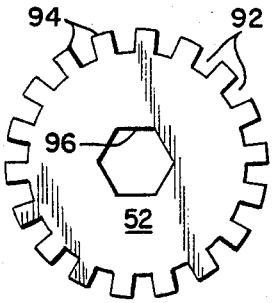
FIGS. 13A–C are detailed views of a second embodiment of a second portion of the mallet driver of the present invention.
Figure 13B:
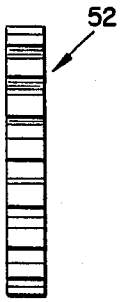
Figure 13C:
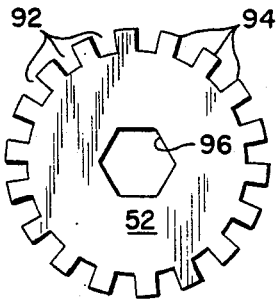

First driver member 50, illustrated in detail in FIGS. 12A–C, and second driver member 52, illustrated in FIGS. 13A–C, are both mounted onto driver shaft 40. First driver member 50 is provided with bearing member 54 about its central hexagonal hole to permit free rotation of member 50 about shaft 40. The Central hexagonal portion of bearing member 54 is secured to shaft 40 to prevent lateral movement of member 50 along shaft 40 While allowing independent rotation of member 50 about shaft 40.

Member 52 is provided with a hexagonal hole which directly couples member 52 and shaft 40, thereby providing for simultaneous rotation of member 52 and shaft 40.

Mallet holder 54 has a hexagonal hole 56 for accomodation of shaft 46. Mallet holder 54 is secured to shaft 46 by means of bolt 58. Shaft 46 and mallet holder 54 therefore rotate together.

Mallet holder 54 has further hole 60 for accomodation of mallet neck 62. The lower end of mallet neck 62 is secured in hole 60 by means of a bolt (not shown). Mallet head 64 is secured to the upper end of mallet neck 62.

Stop member 66 is provided with hexagonal hole 68 for accomodation of shaft 46. Stop member 66 rotates in unison with shaft 46 and mallet holder 54. The lower end of stop member 66 is positioned to the pedal side of upright 74. This prevents shaft 46 from rotating past the point where the lower end of stop member 66 contacts upright 74, and thereby defines the rest position of mallet 64.

The right end of shaft 46 passes through bearing 76 in upright 74 and is seated into hole 78 in end piece 72. Spring member 70, attached to end piece 72, acts like spring member 32 to bias shaft 46 towards counterclockwise rotation as viewed in FIG. 8, arrow B.

The mechanism of the present invention as illustrated in the figures is operated as follows to produce a multibeat sequence. As foot pedal 10 is depressed, drivebelt 18 is pulled downward and causes foot pedal gear 20 to rotate in a clockwise direction as indicated by arrow A in FIG. 8. Drive belt 1 is attached at its lower end to pedal 10 and at its opposite end to gear 20. Belt 8 wraps around gear 20 wherein the prongs 82 of gear 20 are seated within the holes 84 of belt 18. Belt 18 therefore provides a direct drive of gear 20 by pedal 10.

As gear 20 is rotated, ratchet tooth 86 of gear 20 engages one of the ratchet seats 88 of first drive member 50. Ratchet tooth 86 is pivotally mounted and ratchet seats 88 are so configured that ratchet tooth 86 of gear 20 only engages and drives first drive member 50 when rotating in a clockwise direction, as indicated by arrow A. When gear 20 is rotating in a counter-clockwise direction, as indicated by arrow B, ratchet tooth 86 deflects off seats 88 and does not drive first drive member 50.

As first drive member 50 is rotated in a clockwise direction, second drive member 52 which rides within splines 90 of first drive member 50 is also rotated in clockwise direction. However, as second drive member 52 rotates clockwise, it also moves to the right as indicated by arrow C in FIG. 10.

Figure 9:
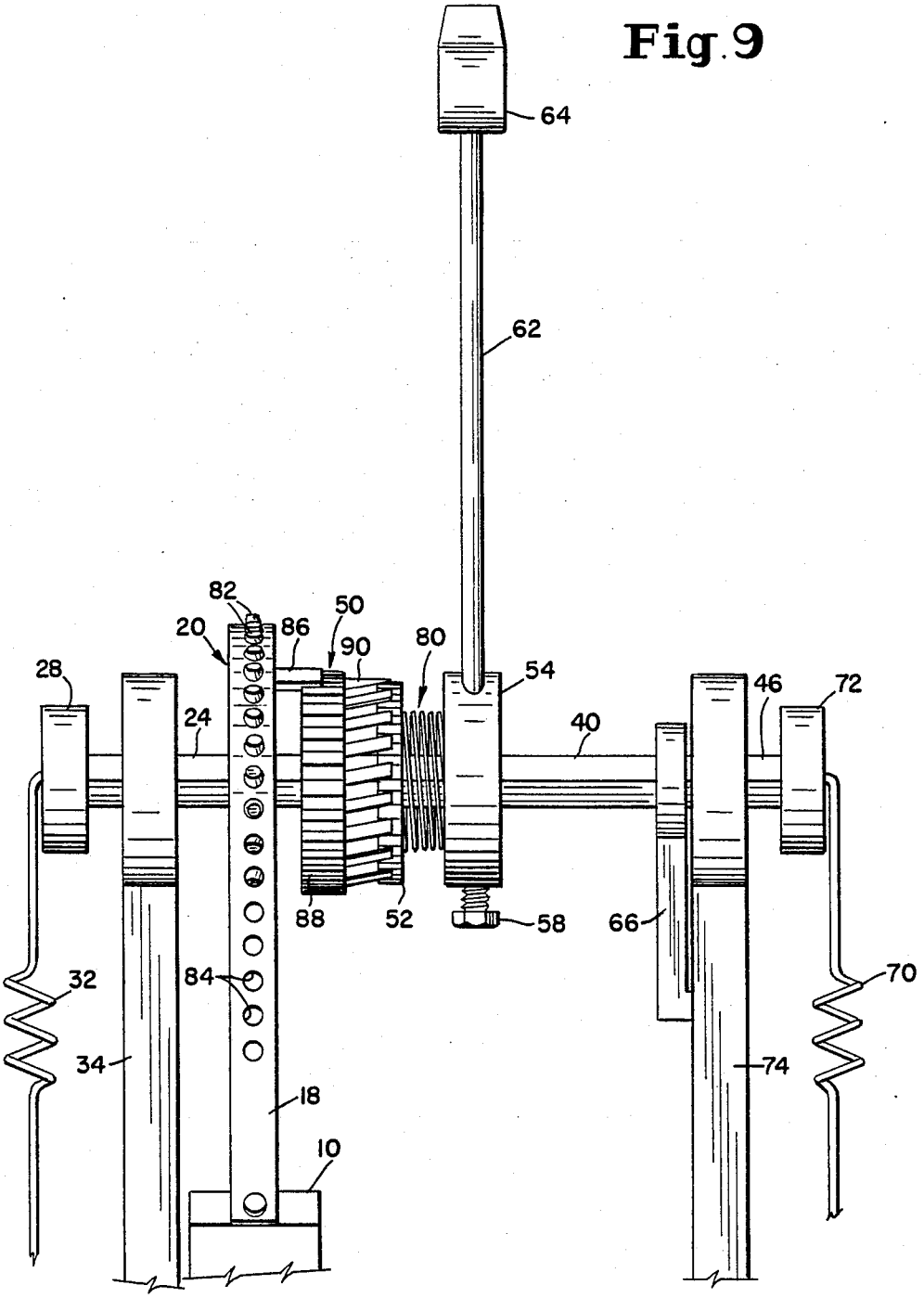
FIG. 9 is a back detailed view of a second embodiment of the components of the hammer-actuating mechanism mounted on their respective shaft components.

As illustrated in FIGS. 9 and 10, splines 90 of first drive member 50 fit into grooves 92 between teeth 94 of second drive member 52. It can be seen that as drive member 50 is rotated it imparts a lateral force to second drive member 52, thereby forcing the two drive members apart.

Once second drive member 52 has moved laterally past the ends of splines 90, the counter-clockwise bias applied to shaft 40 by spring 70 will cause second drive member 52 to snap back in a counter-clockwise motion in unison with mallet 64.

Upon snapping back, second drive member 52 will again engage splines 90 of first drive member 50 and will move laterally to seat against drive member 50 through the bias provided by spring 80. At this time further clockwise rotation of drive member 50 will again cause drive member 52 to move clockwise and away from member 50.

Clockwise rotation of second drive member 52 will cause shaft 40, which is engaged in hexagonal hole 96 of second drive member 52, to rotate clockwise in unison with drive member 52. Since hexagonal end 42 of shaft 40 is engaged into hexagonal hole 44 of shaft 46, then shaft 46 will be driven in a clockwise manner as shaft 40 is driven clockwise. This will, therefore, cause clockwise rotation of mallet holder 54, causing mallet neck 62 and head 64 to move in a manner such as to cause mallet head 64 to strike the drum. It can therefore by seen that a continuous rotation of gear 20 will cause rotation of first drive member 50 which will cause a sequence of rotation and spring returns of second drive member 52. This in turn will cause a sequence of drum beats produced by mallet head 64 striking the drum for each forward partial rotation of second drive member 52. The number of drumbeats produced per degrees of rotation of gear 20 is dependent upon the pitch and length of prongs 90 of drive member 50.

Each time the mallet head 64 snaps back from the bias exerted by spring 70 its travel backwards is arrested by contact of stop member 66 with support member 74. Mallet 64 will thusly be retained in its rest position until rotated forward again through subsequent rotation of gear 20 through continued downward movement of foot pedal 10.

Once foot pedal 10 has reached its lowest position of travel or once the drummer has produced the desired number of drumbeats, the drum player's pressure on foot pedal 10 is released and foot pedal 10 returns to its upward position through the bias of spring 32 on end member 28 which rotates shaft 24 in a counter-clockwise direction to return gear 20 to its neutral position. As stated earlier, gear 20 when rotating in a counter-clockwise direction as indicated by arrow B of FIG. 8 will not exert rotational force on first drive member 50 because ratchet tooth 86 will be deflected on its pivot out of engagement with ratchet seats 88 of the first drive member.

First drive member 50 will not prevent the counter-clockwise return rotation of drive shaft 40 during the interval between successive beats, because of the bearing mounting 54 between first drive member 50 and shaft 40. At all times shafts 40 and 46 move in unison With second drive member 52, mallet 64, mallet holder 54, stop member 66 and end member 72. Therefore, the continued clockwise movement of gear 20 and first drive member 50 will not impede the return of the mallet 64.

Shaft 24 moves in unison with gear 20, pedal 10 and end member 28. The connection between end 26 of shaft 24 and opening 38 in shaft 40 allows of independent rotation of these two sectors of the mechanism. This allows for multiple oscillations of the shafts 40 and 46, second drive member 52, mallet holder 54, mallet 64, stop 66 and end member 72 portion for each single forward clockwise rotation of gear 20, shaft 24 and end member 28 produced by a continuous downward motion of pedal 10. First drive member 50, through its mounting of bearing 54, moves only in a clockwise direction and does not oscillate counter-clockwise with shaft 40. First drive member 50 is only caused to move when ratchet pin 86 operates to produce clockwise motion on first drive member 50.

It can be seen, therefore, that the mechanism as described above allows for successive drumbeats to be produced during a single downward motion of foot pedal 10. Upon release of pressure on foot pedal 10 the mallet returns to its neutral position and does not strike the drum.

Once given the above disclosure, many other features, modifications and improvements will become apparent to the skilled artisan. Such features, modifications and improvements are thus to be considered a part of this invention, the scope of which is to be determined by the following claims:

We claim:

1. A drum hammer drive mechanism, comprising a gear configured for operative connection to a foot pedal, first drive means having a plurality of splines, and rotationally driven in a first direction by rotation of said gear in said first direction, second drive means configured for operative engagement of said splines, and rotationally driven in a first direction by rotation of said first drive means in said first direction, and striking means driven by the rotation of said second drive means in said first direction for striking a drum, first spring bias means for biasing said gear against rotation in said first direction, and second spring bias means for biasing said second drive means against rotation in said first direction, wherein said second drive means is driven through engagement of said second drive means within splines of said first drive means, and rotation of said first drive means in said first direction causes said second drive means to disengage said splines after partial rotation of said second drive means, wherein said second spring means causes said second drive means to rotate a predetermined distance opposite to said first direction upon said disengagement of said second drive means from said splines, and third spring bias means for biasing said second drive means into engagement with said splines, wherein said third spring means causes said second drive means to re-engage said splines after said opposite rotation of said second drive means.

2. A drum pedal assembly, comprising;

a foot operated pedal, a gear, direct linkage connecting said foot pedal and said gear, wherein depression of said pedal causes said gear to rotate in a first direction, first drive means having a plurality of splines, and rotationally driven in a first direction by rotation of said gear in said first direction, second drive means configured for operative engagement of said splines, and rotationally driven in a first direction by rotation of said first drive means in said first direction, and striking means driven by the rotation of said second drive means in said first direction for striking a drum, first spring bias means for biasing said gear against rotation in said first direction, and second spring bias means for biasing said second drive means against rotation in said first direction, wherein said second drive means is driven through engagement of said second drive means within splines of said first drive means, and rotation of said first drive means in said first direction causes said second drive means to disengage said splines after partial rotation of said second drive means, wherein said second spring means causes said second drive means to rotate a predetermined distance opposite to said first direction upon said disengagement of said second drive means from said splines, and third spring bias means for biasing said second drive means into engagement with said splines, wherein said third spring means causes said second drive means to re-engage said splines after said opposite rotation of said second drive means.

3. A drum hammer drive assembly, comprising:

an actuating lever arm adapted for operative connection to a foot pedal, first drive means rotationally driven in a first direction by movement of said actuating lever in said first direction, first spring means for biasing said actuating lever against movement in said first direction, second drive means rotationally driven in a first direction by rotation of said first drive means in said first direction, second spring means for biasing said second drive means against rotation in said first direction, and striking means attached to said second drive means and driven in a first direction by rotation of said second drive means in said first direction, said second drive means being driven by said first drive means through a releasable engagement linkage, wherein upon rotation of said striking means through a drum striking arc of predetermined length, said releasable engagement linkage disengages said first and second drive means and said second spring means causes said second drive means to return rotate in a rotational direction opposite to said first rotational direction upon disengagement of said releasable linkage.

4. The drive assembly of claim 3, wherein said releasable linkage reengages said first and second drive means after sufficient return rotation of said second drive means.

5. The drive assembly of claim 4, wherein said releasable engagement linkage is comprised of at least one resiliently mounted engaging member and at least one socket, wherein said engaging member is biased toward seating in said socket, said first and second drive members are engaged when said engagement member is seated in said socket upon alignment of said engagement member and said socket, and said first and second drive members become disengaged upon the overcoming of said seating bias.

6. The drive assembly of claim 4, further comprising;

a clutch operatively connecting said actuating lever and said first drive means, wherein said clutch engages to transfer the movement of said actuating lever in said first direction to rotation of said first drive member, and disengages to allow the return movement of said actuating lever without accompanying rotation of said first drive means.

7. The drive assembly of claim 6, wherein said striking means is caused to travel through said drum striking arc at least twice for each actuation of said foot pedal.

8. The drive assembly of claim 7, wherein said actuating lever has a rest position and an extended position, wherein said lever travels from said rest position toward said extended position when moved in said first direction, continuous movement of said lever from said rest position in said first direction causes continuous rotation of said first drive means in said first direction, initial rotation of said first driven means in said first direction causes initial rotation of said second drive means in said first direction, wherein at least once prior to said lever reaching said extended position said releasable linkage disengages said first and second drive means.

9. The drive assembly of claim 8, wherein prior to said disengagement, said striking means is rotated a first time through said drum striking arc, and said disengagement of said first and second drive means occurs at a point in the travel of said lever wherein sufficient travel distance remains prior to said lever reaching said extended position so that said lever can be moved a sufficient further distance in said first direction to cause said striking means to rotate a second time through said drum striking arc.

* * * * *